United States Patent [19]

Merritt et al.

[11] 4,266,562

[45] May 12, 1981

[54] PROCESS FOR PUFFING TOBACCO

[75] Inventors: Henry B. Merritt, Richmond, Va.; George F. Kite, Indianapolis, Ind.

[73] Assignee: Philip Morris Incorporated, New York, N.Y.

[21] Appl. No.: 39,754

[22] Filed: May 17, 1979

[51] Int. Cl.[3] ..... A24B 3/18

[52] U.S. Cl. ..... 131/293

[58] Field of Search ..... 131/17 R, 140 P

[56] References Cited

U.S. PATENT DOCUMENTS 3,771,533 11/1973 Armstrong et al. ..... 131/17 R

FOREIGN PATENT DOCUMENTS 1331640 9/1973 United Kingdom ..... 131/140 P

*Primary Examiner*—V. Millin

*Attorney, Agent, or Firm*—Watson, Leavenworth, Kelton & Taggart

[57] ABSTRACT

Tobacco having at least about 6 percent moisture is impregnated with ammonia and carbon dioxide to introduce into the tobacco preferably from about 3 percent to about 6 percent by weight of ammonia and from about 3 percent to about 8 percent of carbon dioxide based on the weight of the tobacco. The impregnated tobacco is then heated for from about 5 to about 60 minutes at a temperature of from about 80° to about 120° C. in an open system to produce a tobacco product, having an OV of about 6% or less. The resulting tobacco product is, either with or without being bulked at room temperature, thereafter contacted with dry steam, preferably at low velocity, at a temperature which may be from about 100° C. to about 150° C., but is preferably from about 100° C. to about 120° C. for a time sufficient to puff the tobacco, preferably from about ¼ to about 3 minutes. A humid gas, such as air of high humidity, may be used in place of the dry steam, in which case the temperature may be between about 80° C. and about 150° C. and is preferably from about 80° C. to about 120° C.

3 Claims, No Drawings

PROCESS FOR PUFFING TOBACCO

BACKGROUND OF THE INVENTION

The desirability of increasing the bulk or volume of tobacco has long been recognized. Among the various reasons for desiring such increase in bulk or volume are compensation for the weight loss caused by the curing process. Increase in filling power permits the use of smaller amounts of tobacco in the production of firm cigarette rods or the like and results in a lower delivery of tar and nicotine than a comparable product made of unexpanded tobacco.

Many different methods have been suggested in the art for puffing or expanding the volume of tobacco. For example, in U.S. Pat. No. 1,789,435 to Hawkins, tobacco is expanded by subjecting tobacco to a gas under pressure, which causes the gas to penetrate the constituents of the tobacco. Thereafter, the pressure is suddenly released whereupon the gas trapped in the tobacco expands. Among the gases mentioned as usable in the process are air, carbon dioxide and steam. The gas may be heated to facilitate the process.

According to the method of British Pat. No. 1,331,640, tobacco is impregnated with a compound capable of liberating a gas under conditions which do not impair the quality of tobacco. Non-gaseous chemical compounds which liberate gases, such as carbon dioxide, nitrogen, oxygen and ammonia, upon thermal decomposition may be employed. Preferred compounds are those which decompose at relatively low temperature including ammonium carbonates, ammonium carbamates, organic dicarboxylic acids and peroxides. In one embodiment, tobacco is impregnated with an aqueous solution of ammonium carbonate and is then heated with a stream of live steam at 120° C. to cause it to expand.

Tobacco expansion processes for enhancing the utility of tobacco stems for use in tobacco products are described in U.S. Pat. Nos. 3,409,022, 3,409,023, 3,409,027 and 3,409,028 all to Burde. According to the processes described, tobacco stems are expanded by means of radiant heat or microwave energy. A method of preparing reconstituted tobacco sheets from puffed tobacco are also described. A further enhancement of the puffed product obtained from tobacco stems is described in U.S. Pat. No. 3,425,425 to Hind. In this patent, tobacco stems are treated with a solution of water-soluble carbohydrate prior to expansion.

In U.S. Pat. No. 3,771,533 to Armstrong et al, assigned to the same assignee as the present invention, the various disadvantages of the above-described and other prior art processes of tobacco expansion are noted. For example, some of the methods involve only moderate expansion, are not effective on tobacco leaf as well as tobacco stem, require elaborate and expensive equipment and/or involve introduction of foreign materials into the tobacco.

According to the expansion method of the Armstrong et al patent, tobacco is treated with liquid or gaseous ammonia or with ammonium hydroxide or a combination of ammonia and carbon dioxide followed by heating to temperatures of from 250° F. to 700° F. for a time sufficient to puff the tobacco. Carbon dioxide may be added before, during or after the ammonia is introduced. The carbon dioxide may be introduced as a gas, or in powdered form, or in combination with the ammonia in the form of ammonium carbonate or bicarbonate which may be applied directly or formed in situ.

Other methods have also been proposed to overcome some of the difficulties of the presently known techniques. For example, in copending application Ser. No. 912,029, filed June 2, 1978 to Lendvay et al and assigned to the same assignee as the present application, a continuous process for impregnation and expansion of tobacco using ammonium hydroxide and solid carbon dioxide or using aqueous ammonium carbamate as an impregnant is provided. That process avoids certain difficulties of the known ammonia carbon dioxide process, for example, by avoiding build-up of ammonium salts.

The present invention provides an improved method for heating tobacco which has been impregnated with ammonium carbonate and similar materials over both the Armstrong et al and the Lendvay et al heating methods, as well as over other prior art techniques

BRIEF SUMMARY OF THE INVENTION

Tobacco having at least about 6 percent moisture is impregnated with ammonia and carbon dioxide to introduce into the tobacco preferably from about 3 percent to about 6 percent by weight of ammonia and from about 3 percent to about 8 percent of carbon dioxide based on the weight of the tobacco. The impregnated tobacco is then heated for from about 5 to about 60 minutes at a temperature of from about 80 to about 120° C. in an open system to produce a tobacco product, having an OV of about 6% or less. The resulting tobacco product is, either with or without being bulked at room temperature, thereafter contacted with dry steam, preferably at low velocity, at a temperature which may be from about 100° C. to about 150° C., but is preferably from about 100° C. to about 120° C. for a time sufficient to puff the tobacco, preferably from about ¼ to about 3 minutes. A humid gas, such as air of high humidity, may be used in place of the dry steam, in which case the temperature may be between about 80° C. and about 150° C. and is preferably from about 80° C. to about 120° C.

DETAILED DESCRIPTION OF THE INVENTION

In the process of the invention, whole cured tobacco leaf, tobacco in cut or chopped form, or selected parts of tobacco such as tobacco stems or reconstituted tobacco may be employed. The tobacco may be bright, burley, oriental, or other. In comminuted form, the tobacco may have a particle size of about 20 to 5 mesh or larger, but preferably is not less than about 30 mesh. The tobacco may be in relatively dry form, or may contain its natural moisture content. Preferably, the tobacco should have at least about 6 percent moisture but less than about 35 percent moisture.

The tobacco is impregnated by known methods to contain from about 3 percent to about 6 percent (by weight) of ammonia, in water-soluble form, and from about 3 percent to about 8 percent (by weight) of carbon dioxide, based on the weight of the tobacco. For example, the methods taught in U.S. Pat. No. 3,771,533 for the impregnation step may be employed.

The impregnant medium may be a combination of ammonia gas and carbon dioxide gas or may be ammonium carbonate, ammonium carbamate or similar materials.

The tobacco may be pretreated with liquid or gaseous ammonia or with ammonium hydroxide to permit absorption of ammonia into the tobacco cellular structure, followed by $CO_2$ in gas, liquid, or solid form. The tobacco may also be contacted with either ammonium carbonate or ammonium bicarbonate applied directly, or formed in situ by the reaction of ammonia with carbon dioxide and moisture in the tobacco. A preferred method is to introduce both ammonia and carbon dioxide gases into the tobacco.

The treatment of tobacco may be with substances capable of evolving ammonia and carbon dioxide such as by incorporating ammonium carbonate or bicarbonate or ammonium carbamate in the tobacco to be treated. Sufficient time is provided to result in impregnating at least 2 percent by weight of ammonia or its equivalent and at least 3 percent by weight of $CO_2$ into the tobacco cell structure for acceptable expansion, with 3 percent to 6 percent by weight of ammonia and 3 to 8 percent by weight of $CO_2$ being preferred.

While ammonia by itself is a satisfactory puffing agent, it has been found that excellent results are achieved by combining the effects of ammonia and carbon dioxide puffing by introducing both of these expansion agents into the tobacco. To obtain the combined effects of $NH_3$ and $CO_2$, a preferred procedure is to expose tobacco to ammonia vapors or gas, then $CO_2$ gas or the reverse, and, if desired, adding powdered carbon dioxide, allowing the ammonia and carbon dioxide sufficient time to be absorbed. About 10 minutes to an hour of exposure to the ammonia vapor followed by the same length of time for $CO_2$ with cooling by the use of a water jacket of the like will yield a satisfactory amount of impregnation. The absorption may be improved if the impregnation vessel is first evacuated to a low initial pressure up to 26 in. of mercury absolute. The amounts and rates of absorption are determined by the rates at which heat can be dissipated from the mass of tobacco undergoing treatment and the final temperature attained since there is an exothermic heat of solution and reaction of the ammonia, carbon dioxide and the moisture in the tobacco. It is, therefore, best to keep the temperature of the tobacco undergoing absorption at a reasonably low point below about 100° F.

In the impregnation of tobacco with carbonates, whether by contacting the tobacco with ammonia and carbon dioxide, or when these gases are produced from impregnation with ammonium carbonate or bicarbonate, good subsequent expansion to densities of about 0.25 has been found when the individual levels of ammonia and $CO_2$ in the penetrated tobacco is in the range of about 3 to 6 percent by weight of soluble ammonia and 3 to 8 percent by weight of carbon dioxide.

An important advantage in the use of ammonium carbonate or bicarbonate is the fact that these compounds easily decompose at temperatures quite substantially below the charring temperature of tobacco. A still further advantage is that the treated tobacco need not be expanded immediately but may be stored or handled for short periods in air without loss of puffing capacity After the tobacco has been contacted with the ammonia and carbon dioxide, or with the alternative impregnants described above, it is then treated as follows.

The impregnant-containing tobacco, for example, the ammonia-carbon dioxide-containing tobacco is placed in an unsealed or partially open vessel, e.g., a convection or forced-draft oven for batch operation or a heating zone traversed by an open-mesh conveyor belt for continuous operation, and is maintained at a temperature of from about 80° C. to about 120° C., preferably from about 80° C. to 100° C., at atmospheric pressure for from about 5 to about 60 minutes, preferably from about 10 to 30 minutes to produce a tobacco product having an OV of about 6% or less, and preferably about 4 to 6%. The atmosphere in the vessel or heating apparatus may be air, $CO_2$ and/or $NH_3$ or any inert gas.

The resulting tobacco is then removed from the vessel and may be bulked, i.e., held for a period of time, preferably for about 5 to 10 hours, at room temperature, without further heating, in a closed container. Either with or without the bulking step, the resulting tobacco is then treated with dry steam, preferably at about atmospheric pressure and a temperature of from about 100° C. to about 150° C., preferably from about 100° C. to about 120° C., preferably for a period of from about ¼ to about 3 minutes, most preferably about 30 to 45 seconds, to expand the tobacco.

An alternative to dry steam is hot, humid air or other inert gas at a temperature which is between about 80° C. and 150° C. and which is also above its dew point. Thus, air at a temperature of 80° C. having a dew point higher than 70° C. or air at a temperature of 105° C. with a dew point of 95° C., will serve to expand tobacco within the time range indicated above.

The steam treatment or humid gas treatment may be conducted, for batch operation, in a container provided with a screen or other porous horizontal support on which the tobacco is placed, while the dry steam or hot humid air or other inert gas is introduced below the screen and an outlet is located above the screen or the space above the screen is not confined. For continuous operation, the tobacco may be carried through the treating zone on a porous conveyor belt, while the heating gas is introduced below the belt so as to flow through the conveyor and the impregnated tobacco. Clearly, other arrangements can be devised that would permit the necessary length of contact between the tobacco and the heating gas.

While we do not wish to be bound by any particular theory, we believe the important feature in this expansion operation is that the major part of the heat transfer is through water vapor condensation.

The tobacco, after expansion, may then be reordered by any conventional method to normal use moisture levels, such as that which is in equilibrium with air at 60% r/h, 24° C.

The advantages of the present method over that shown in U.S. Pat. No. 3,771,533 or in U.S. Ser. No. 912,029 reside in the lower exposure temperature of the expansion step, which signifies less opportunity for scorching, and lower energy requirements. This method also permits operation, under proper conditions, which do not require a reordering step after expansion. The equipment in which the step may be carried out may be less complex and less expensive, because resistance to high temperature is not required. Furthermore, high velocity gas flow, which provides a turbulence needed for good heat transfer in the absence of a phase change (such as the condensation involved in the present process) is also not required. The present process lends itself to continuous operation, for example, wherein the tobacco, disposed on a porous conveyor belt, can be impregnated and carried through the steps of the present process, as well as reordering, if desired, without further transfer or handling.

As described herein, a density of the final puffed tobacco product in the range of 0.25 to 0.60 g/cc is preferred.

Preferably, ammonium carbonate-impregnated bright filler (tobacco) is heated in an open system to remove the external portion of the applied ammonia, carbon dioxide and water, equilibrated in a sealed container (optional) and expanded by contact with dry, low temperature, low velocity steam. Ammonium carbonate impregnated bright filler (containing 3-6% soluble $NH_3$ and 3-8% $CO_2$ and having 17-22% O.V.) is heated for 5-60 minutes (preferably 10-30 minutes) at 80°-120° C. (preferably 80°-100° C.) in a forced draft oven. The dry filler may be held in a sealed container for 5-10 hours (preferably 5-6 hours) at room temperature and then contacted with dry, 100% steam at 100°-150° C. (preferably 105°-120° C.) or with hot air at 80°-150° C. wherein the dew point is 70°-95° C. in a static or fluidized bed or other low steam velocity device at which time cellular expansion occurs. The expanded filler is then reordered to its equilibrium moisture content at 24° C., 60% r/h. The principle of this invention centers on the use of the heat of condensation of steam to transfer heat into relatively dry, impregnated filler to effect expansion, as opposed to heat transfer from a hot gas stream.

The following example is illustrative.

EXAMPLE 1

Fifty pounds of commercial, bright tobacco (11-12% O.V.) was impregnated with ammonium carbonate in a small ball impregnator to give a treated tobacco containing 3.31 weight percent $NH_3$ (in water-soluble form) and 4.6 weight percent $CO_2$ at 18.4 percent O.V. One hundred grams of this impregnated tobacco was spread on a tray in a forced draft oven and maintained there at 100° C. for 10 minutes. The tobacco was then removed from the oven and sealed in a quart jar for 5 hours at room temperature to give a dry tobacco containing 1.97 weight percent $NH_3$ and 1.8 weight percent $CO_2$, at 5.4 percent O.V.

The dry, equilibrated tobacco was then spread in 5 gram batches on a wire screen over a steam bath (inlet steam temperature 120° C.) and exposed to the steam at atmospheric pressure for 15 seconds per batch to expand the tobacco.

The expanded tobacco was equilibrated for 72 hours under standard conditions (75° F., 60% r/h) and gave a cylinder volume (steel) of 70.4 cc/10 g at 10.37% O.V.

Among the advantages of the present invention are the following:

1. Relatively low expansion temperatures, with less volatiles loss (casings, nicotine, etc.) and less chance of overheating or burning the tobacco.
2. Relatively low expansion gas velocities, with less filler (tobacco) breakage.
3. Relatively lower capital costs (no tower, etc. need be used).
4. Relatively lower energy requirements, due to overall lower temperatures.
5. Possible elimination of a reordering step.

A measurement of the expansion effect produced in the tobacco by the above procedures may be carried out by determining the percentage of the product that floats on a specific low density liquid such as acetone, petroleum ether or hexane, or by measuring the density of the product by a simple application of the weight in air vs. weight in liquid method, with acetone as the immersion liquid. A perforated metal case (conveniently a tea ball) holds the sample (3-5 g). The weight in liquid is recorded when the balance has come to rest (60 to 90 seconds). The only precaution is to see that all bubbles have been released by tapping the case, if necessary, during both the tare and sample weighings.

As used throughout the specification, the term "cylinder volume" is a unit for measuring the degree of expansion of tobacco. The term "oven-volatiles content" or "oven volatiles" (OV) is a unit for measuring moisture content (or percentage of moisture) in tobacco. As used throughout this application, the values employed, in connection with these terms, are determined as follows.

Cylinder Volume (CV)

Tobacco filler weighing 10.000 g. is placed in a 3.358 cm diameter cylinder and compressed by a 1875 g piston 3.335 cm in diameter for 5 minutes. The resulting volume of filler is reported as cylinder volume. This test is carried out at standard environmental conditions of 23.9° C. and 60% r/h; conventionally unless otherwise stated, the sample is preconditioned in this environment for 18 hours.

Oven-Volatiles Content (OV)

The sample of tobacco filler is weighed before and after exposure for 3 hours in a circulating air oven controlled at 100° C. The weight loss as percentage of initial weight is oven-volatile content.

What is claimed is:

1. The process of expanding tobacco which comprises the steps of:

(a) contacting tobacco having at least 6 percent by weight moisture with a source of ammonia and carbon dioxide to introduce into the tobacco preferably from about 3 percent to about 6 percent by weight of water-soluble ammonia and from about 3 percent to about 8 percent of carbon dioxide, based on the weight of the tobacco, (b) heating the resulting tobacco in an open vessel at temperatures of from about 80° C. to about 120° C. and substantially atmospheric pressure for a period of from about 5 to 60 minutes to produce a tobacco product having an OV of about 6% or less, and (c) thereafter expanding the tobacco product with dry steam at a temperature of from about 100° C. to about 150° C. or a water vapor-containing gas at a temperature of from about 80° C. to about 150° C. and above the dew point of the gas for a time sufficient to expand the tobacco.

2. The process of claim 1 wherein step (c) is conducted for a period of from about ¼ to 3 minutes.

3. The process of claim 1, wherein the treated tobacco from step (b) is held in a sealed container at room temperature for a period of at least 5 hours, prior to being contacted in accordance with step (c).

* * * * *